US006059926A

United States Patent [19]

Hiroshima

[11] Patent Number: 6,059,926

[45] Date of Patent: May 9, 2000

[54] METHOD FOR MANUFACTURING A PAPER DIAPHRAGM FOR A LOUD SPEAKER

[75] Inventor: Yukimi Hiroshima, Hiroshima, Japan

[73] Assignee: Sharp Kabushiki Kaisha, Osaka, Japan

[21] Appl. No.: 08/783,284

[22] Filed: Jan. 10, 1997

Related U.S. Application Data

[63] Continuation of application No. 08/403,124, Mar. 13, 1995, abandoned, which is a continuation of application No. 07/985,267, Dec. 3, 1992, abandoned.

[30] Foreign Application Priority Data

Jan. 31, 1992 [JP] Japan ..... 4-015661

[51] Int. Cl.[7] ..... D21B 1/36

[52] U.S. Cl. ..... 162/21; 162/231

[58] Field of Search ..... 162/9, 21, 23, 162/231, 91, 99; 181/169

[56] References Cited

U.S. PATENT DOCUMENTS

| | | | |
|---|---|---|---|
| 1,586,159 | 5/1926 | Mason | 162/21 |
| 1,663,503 | 3/1928 | Mason | 162/21 |
| 1,952,169 | 3/1934 | Hawley | 162/219 |
| 2,007,341 | 7/1935 | Olsen et al. | 162/21 |
| 2,080,078 | 5/1937 | Mason et al. | 162/21 |
| 2,899,242 | 6/1959 | Teichmann | 162/21 |
| 3,003,191 | 10/1961 | Luth | 181/169 |
| 3,617,433 | 11/1971 | Sutherland | 162/21 |
| 3,935,924 | 2/1976 | Nagao et al. | 181/169 |
| 4,374,702 | 2/1983 | Turbak et al. | 162/9 |
| 4,803,242 | 2/1989 | Musata | 162/158 |
| 5,074,959 | 12/1991 | Yamamaka et al. | 162/9 |
| 5,206,466 | 4/1993 | Inamiyer | 181/169 |

FOREIGN PATENT DOCUMENTS

| | | | |
|---|---|---|---|
| 0200409 | 11/1986 | European Pat. Off. | 162/91 |
| 457474 | 11/1991 | European Pat. Off. | 83/169 |
| 0006595 | 1/1981 | Japan | 181/169 |
| 0007298 | 1/1985 | Japan | 181/169 |
| 354613 | 11/1972 | U.S.S.R. | 162/219 |
| 2165865 | 4/1986 | United Kingdom | 162/91 |

OTHER PUBLICATIONS

"The Material and Manufacture of Loudspeaker Cones" (The Journal of the Acoustical Society of Japan, vol. 30, No. 9, Sep., 1974).

*Primary Examiner*—Brenda A. Lamb
*Attorney, Agent, or Firm*—Nixon & Vanderhye P.C.

[57] ABSTRACT

To manufacture a diaphragm of the present invention for use in a loud speaker, first a suspension is made by putting fibers consisting chiefly of polysaccharide constituting fibrous molecules into water. Next, suitable pressure is applied to the suspension and then the suspension is jet out into the air of normal pressure. As a result, water which has penetrated into the fibers expands rapidly. This causes the fibers to be sufficiently loosen and split into fibrils. When the fibrils are used for manufacturing a diaphragm, since the fibrils get sufficiently entangled together, a highly stiff and elastic diaphragm with high internal loss is obtained. Optimum fibrils are obtained by simply adjusting the pressure. Therefore, the control of the manufacturing process is simplified.

15 Claims, 4 Drawing Sheets

METHOD FOR MANUFACTURING A PAPER DIAPHRAGM FOR A LOUD SPEAKER

This is an FWC of application Ser. No. 08/403,124, filed Mar. 13, 1995, now abandoned which is an FWC of application Ser. No. 07/985 filed Dec. 3, 1992, now abandoned.

FIELD OF THE INVENTION

The present invention relates to the diaphragm of a loud speaker, especially to material of and a method for manufacturing a diaphragm.

BACKGROUND OF THE INVENTION

Diaphragms which are produced from paper made from wood pulp are often used in loud speakers. In the process of manufacturing a diaphragm for a loud speaker, a beating operation is followed by a paper making operation, in general. During the beating operation, external mechanical forces are applied to shear, compress and crush bundles of fibers by a beater.

The objectives of the beating operation are to soften the fibers by splitting the fibers into fibrils, that is, minute fibers like root hair and to cause the fibers to become firmly entangled together in the subsequent paper making operation. This operation imparts good physical properties such as tear strength, tensile strength and elasticity to a paper diaphragm.

As shown in FIG. 4(*a*), a wood pulp fiber 60 has an outer layer as secondary walls to hold fibrils inside of the walls. The outer layer structure is finer than the inner structure of the wood pulp fiber 60.

Mechanical forces are applied while making the blade of the beater contact with the wood pulp fiber 60, and the resultant fiber 70 is shown in FIG. 4(*b*). Fibrils 70*a* are exposed at the cut sections on both ends of the fiber 60 and at a damaged section of the outer layer. However, the exposed fibrils 70*a* are short and the outer layer is not crushed sufficiently.

In a conventional method for manufacturing a diaphragm for a loud speaker, external mechanical forces are repeatedly applied to the fibers 70. Therefore, at the time the fibers 70 are split into the fibrils 70*a*, the fibers 70 are cut up and the fiber tissues are destroyed, resulting in deterioration of the physical properties of paper. Additionally, since only a small amount of the fibrils 70*a* are exposed, the fibers 70 do not get entangled together in paper making. Furthermore, it is difficult to expose a substantially uniform amount of fibrils 70*a* every time the wood pulp fibers 60 are beaten.

Thus, in the conventional manufacturing method, it is complicated to control the beating operation and difficult to manufacture diaphragms with uniform quality. And this causes the quality of loud speakers to become inconsistent.

SUMMARY OF THE INVENTION

In view of the above-mentioned problems, it is an object of the present invention to provide a simplified method for manufacturing a diaphragm for a loud speaker and to provide diaphragms with uniform quality and good physical properties by splitting fibers into fibrils without using external mechanical forces.

To achieve the above-mentioned object, a method for manufacturing a diaphragm for a loud speaker of the present invention includes the steps of:

(a) making a suspension by putting into water fibers (for example, cellulose or chitin) consisting chiefly of polysaccharide constituting fibrous molecules;

(b) applying pressure to the suspension and then causing the suspension to jet out into the air of normal pressure so as to split the fibers into fibrils; and (c) making paper from the fibrils.

With this method, by soaking the fibers in water and applying suitable pressure thereto, water penetrates into the fibers and causes the fibers to swell. When the suspension containing swollen fibers is jet out into the air of normal pressure, water in the fibers expands rapidly and causes the fibers to burst. As a result, the outer layer of the fibers is completely broken and the fibers are split into fibrils almost thoroughly. Since these fibrils become sufficiently entangled together in paper making, it is possible to manufacture a paper diaphragm with good physical properties, such as tear strength, tensile strength and elasticity. In addition, since optimum fibrils are obtained by simply adjusting the pressure to be applied to the suspension, a simplified method for manufacturing a diaphragm is achieved.

Thus, the method for manufacturing a diaphragm of the present invention stably and easily provides a highly stiff and elastic diaphragm with a high internal loss and provides a loud speaker with good acoustic properties as less distortion and high resonant frequency.

To achieve the above-mentioned object, a diaphragm for a loud speaker of the present invention is made of fibrils that were obtained by causing water, which has penetrated into fibers consisting chiefly of polysaccharide constituting fibrous molecules, to expand rapidly for splitting the fibers into the fibrils.

In this arrangement, fibrils are obtained by causing water in the fibers to expand rapidly, and the fibrils thus obtained are used as raw material of the diaphragm. By adjusting the pressure suitably during the expansion of water, the length and the amount of the fibrils obtained become considerably greater than those of fibrils obtained by applying external mechanical forces to the fibers. Thus, for example, the diaphragm produced from paper made from such fibrils has satisfactory physical properties as tear strength, tensile strength and elasticity because the fibrils get sufficiently entangled together.

As to explain in more detail the structure of the above-mentioned fiber, it is a fibrous molecule formed by the condensation polymerization of glucose or glucose derivatives. As for fibers consisting chiefly of glucose, for example, cellulose (as wood pulp, bamboo pulp, bamboo grass pulp, etc.) is known. And, chitin and chitosan are given as fibers composed mainly of glucose derivatives.

For a fuller understanding of the nature and advantages of the invention, reference should be made to the ensuing detailed description taken in conjunction with the accompanying drawings.

DESCRIPTION OF THE EMBODIMENTS

Figure 1:
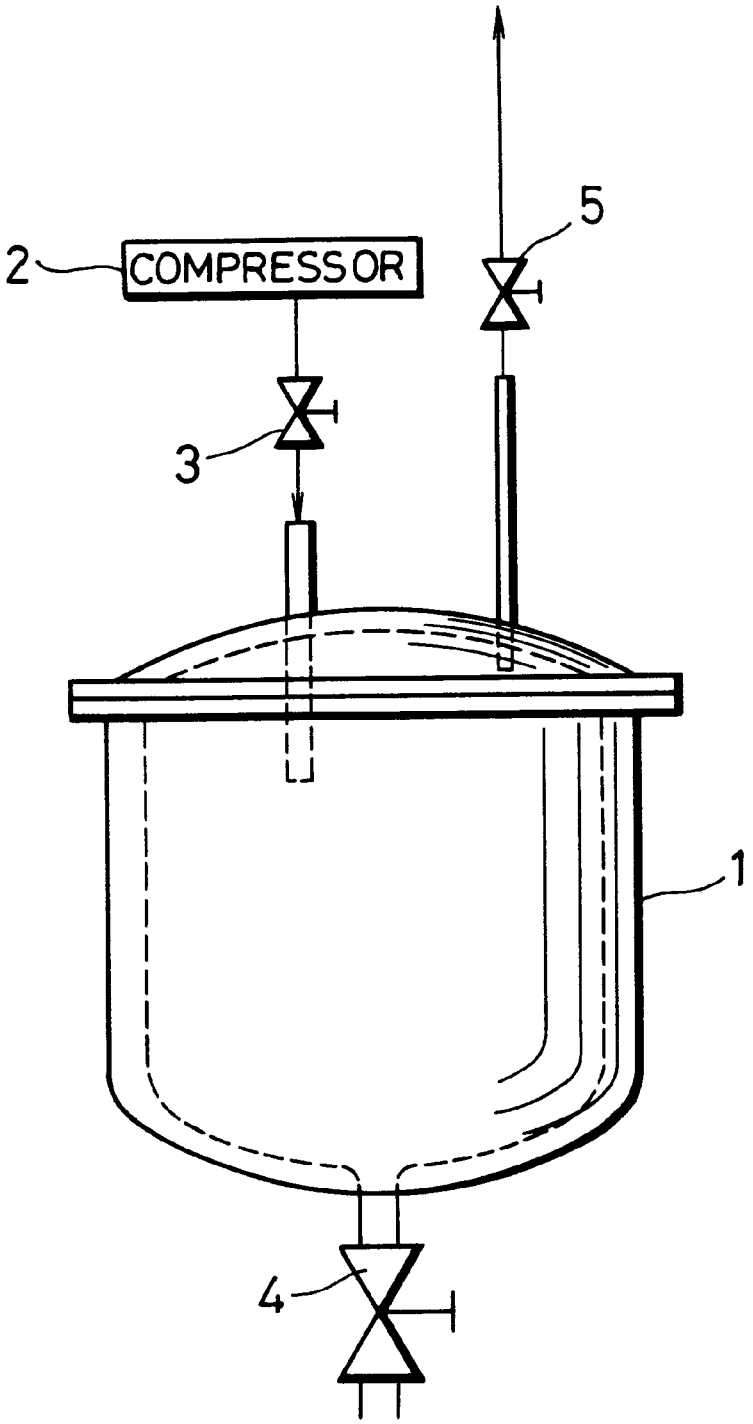
FIG. 1 is a side view schematically showing a pressure-proof container used when giving pressure to and jetting out a liquid mixture containing a wood pulp in a manufacturing method of the present invention.
Figure 2A:
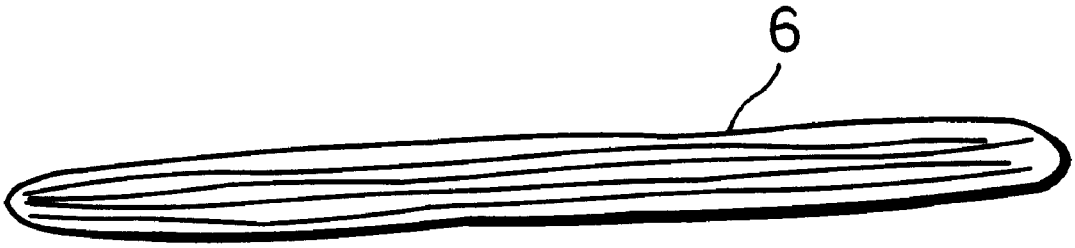
FIG. 2(*a*) is an enlarged explanatory view schematically showing the wood pulp fiber, and FIG. 2(*b*) is an explanatory view schematically showing fibrils into which the wood pulp fiber is split.
Figure 2B:
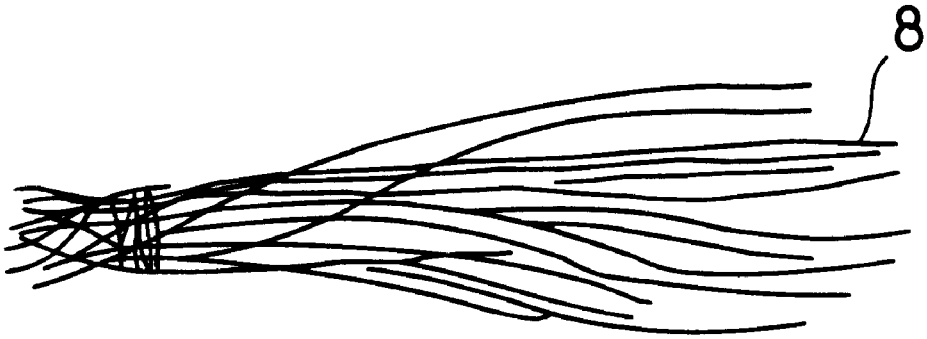
Figure 3:
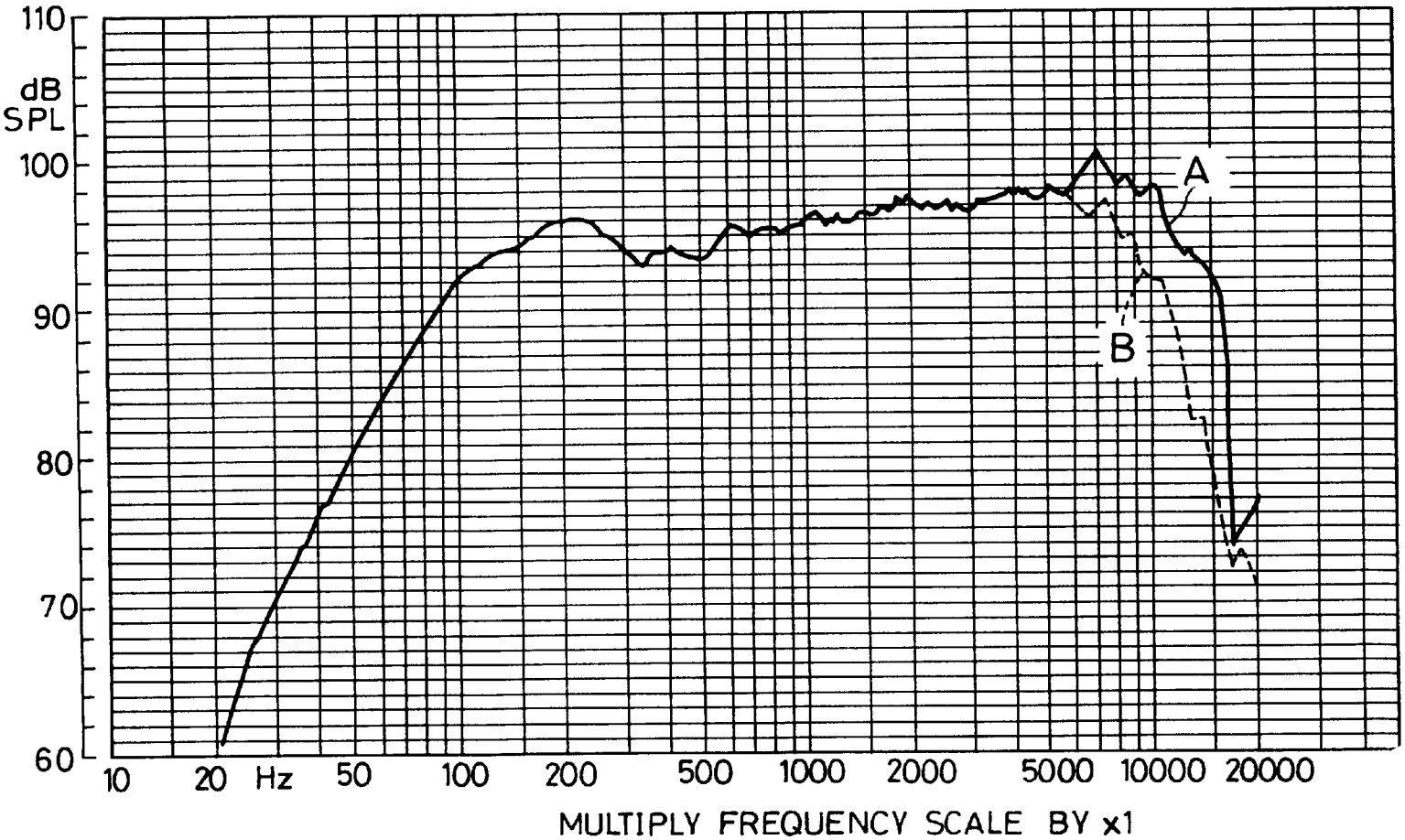
FIG. 3 is a graph showing the frequency-response characteristics of a loud speaker with a diaphragm of the present invention, and of a similar conventional loud speaker.

The following description discusses one embodiment of the present invention with reference to FIGS. 1 through 3.

As shown in FIG. 2(*a*), a wood pulp fiber 6 has an outer layer as secondary walls to hold minute fibers called fibrils inside the walls. The outer layer structure is finer than the inner structure and thus is not sufficiently crushed by external mechanical forces, for example, by beating.

Against such a background, the present invention proposes the following method to easily and sufficiently loosen the wood pulp fiber 6.

First, the wood pulp fibers 6 before beaten are put into water to make a suspension containing six weight percent of the wood pulp fibers 6. Secondly, as shown in FIG. 1, the suspension is put into a pressure-proof container 1 provided with an exhaust safety valve 5. Then, compressed air from a compressor 2 is introduced into the pressure-proof container 1 through a valve 3 so as to increase the pressure within the pressure-proof container 1 to a suitable value, for example, about 8 kg/cm$^2$.

Next, when the wood pulp fibers 6 swell to a large extent because of the penetration of water into the wood pulp fibers 6, a jet valve 4, located at the bottom of the pressure-proof container 1, is opened to jet out the compressed fiber-containing suspension into the air of normal pressure. At this time, the water in the fibers rapidly expands and causes the wood pulp fibers 6 to burst. As a result, the outer layer of the wood pulp fibers 6 is sufficiently crushed and the wood pulp fibers 6 are completely split into minute fibrils 8 as illustrated in FIG. 2(*b*).

In the method of the present invention, since external mechanical forces are not applied to the wood pulp fibers, a damaging effect on the fibers is reduced. Namely, cutting of the fibers and destroying of the fiber structure occur less, giving satisfactorily long fibrils 8. Since such fibrils 8 get entangled together sufficiently during paper making operation, it is possible to produce for diaphragms a stiff material with good physical properties, such as high tear and tensile strength and elasticity. In addition, since the level of crushing the outer layer is easily controlled by adjusting the pressure within the pressure-proof container 1, it is possible to produce the material with satisfactory quality while simplifying the control of the manufacturing process of the fibrils 8.

Figure 4A:
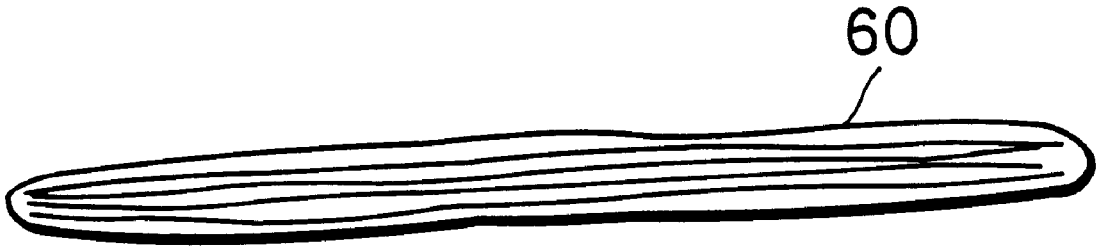
FIG. 4(*a*) is an enlarged explanatory view schematically showing the wood pulp fiber, and FIG. 4(*b*) is an enlarged explanatory view schematically showing a conventional wood pulp fiber after beaten.
Figure 4B:
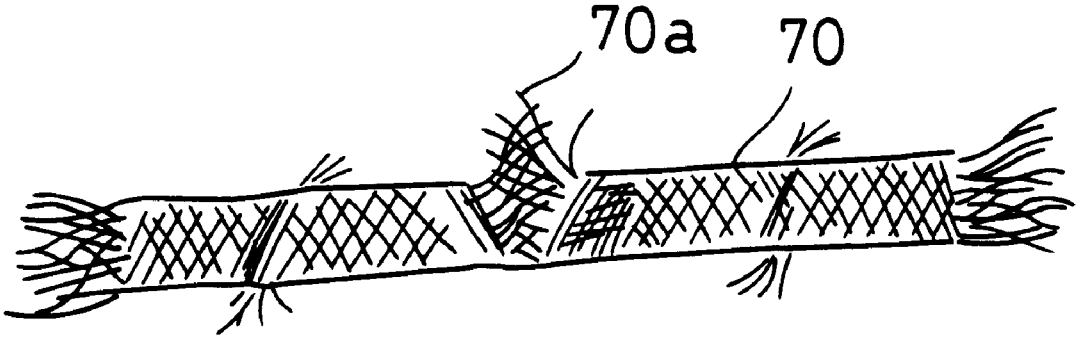

A conical diaphragm with a 12 cm-bore was made from this material. Meanwhile, a diaphragm of the same shape was produced as a comparative example in a conventional manner from wood pulp fibers, shown in FIG. 4(*b*), beaten by a hollander beater. The physical properties of the respective diaphragms were measured, and Table 1 gives the results.

TABLE 1

| Diaphragm | Elastic Modulus [N/m] | Density [g/cc] | Internal Loss tan δ |
|---|---|---|---|
| Present Invention | $0.32 \times 10^{10}$ | 0.65 | 0.04 |
| Comparative Example | $0.20 \times 10^{10}$ | 0.55 | 0.05 |

It is seen from Table 1 that the elastic modulus of the diaphragm of the present invention is improved. Accordingly, the diaphragm of the present invention has improved transient response and characteristic in a high frequency range in comparison to those of the conventional diaphragm.

As for density, one of the characteristics of a diaphragm made of paper is that it has significantly reduced density compared to those of diaphragms made of other materials like metallic materials. The low density improves the efficiency of the diaphragm and the transient response.

With regard to internal loss, in comparison to the diaphragms made of other materials like metallic materials, the paper diaphragm has a sufficiently large internal loss to restrain the bending vibration of the diaphragm and to reduce harmonic distortion. Restraining of bending vibration also restrains peak and dip in the frequency-response characteristic due to bending vibration.

Two loud speakers of the same type, one incorporating the diaphragm of the present invention and the other incorporating that of the comparative example, were prepared. The frequency-response characteristic of the loud speaker of the present invention is indicated as A and that of the loud speaker of the comparative example is shown as B in FIG. 3. The vertical line of FIG. 3 indicates sound pressure level in dB.

As described above, as the elasticity of the diaphragm of this embodiment is improved, the reproducible range of the loud speaker for the high notes is widened and the high resonant frequency becomes higher. Namely, the loud speaker has improved acoustic properties.

Wood pulp fibers were used in this embodiment. However, it is also possible to use fibers obtained from vegetable matter (as bamboo pulp and bamboo grass pulp) that consist chiefly of cellulose, and fibers like chitin and chitosan which are structurally similar to cellulose. Cellulose is constituted by fibrous molecules which are formed by the condensation polymerization of glucose, while fibers which are structurally similar to cellulose are constituted by molecules formed by the condensation polymerization of glucose derivatives.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for manufacturing a paper diaphragm for a loud speaker comprising the steps of:

(1) suspending fibers consisting essentially of polysaccharide molecules in water to form a suspension;

(2) placing said suspension formed in step (1) into a pressure-proof container;

(3) applying pressure to said suspension in said pressure-proof container;

(4) when said fibers swell by penetration of water into said fibers, letting out said suspension from said pressure-proof container thereby rapidly expanding said suspension so as to burst said fibers from the inside into fibrils; and (5) making a paper loud speaker diaphragm using the fibrils.

2. The method for manufacturing a paper diaphragm for a loud speaker according to claim 1, wherein said fibers are selected from a group consisting of vegetable fibers.

3. The method for manufacturing a paper diaphragm for a loud speaker according to claim 1, wherein said fibers include cellulose.

4. The method for manufacturing a paper diaphragm for a loud speaker according to claim 1, wherein said fibers include fibrous molecules which are formed by a condensation polymerization of glucose derivatives.

5. The method for manufacturing a paper diaphragm for a loud speaker according to claim 1, wherein said fibers are selected from a group consisting of chitin and chitosan.

6. A method of manufacturing a loud speaker diaphragm, said method comprising the steps of:

pressurizing a water suspension of fibers until the fibers swell by penetration of water into said fibers;

rapidly de-pressurizing said water-swelled fibers so as to burst said fibers from the inside into fibrils; and making a paper loud speaker diaphragm using said fibrils.

7. A method as in claim 6 wherein said pressurizing step includes pressurization to a level up to about 8 $kg/cm^2$.

8. A method as in claim 6 wherein said rapidly de-pressurizing step includes opening a valve to permit free-expansion jetting therethrough of the pressurized water suspension.

9. A method as in claim 6 wherein said fibers consist chiefly of fibrous polysaccharide molecules.

10. A method as in claim 9 wherein said fibers are selected from a group consisting of vegetable fibers.

11. A method as in claim 9 wherein said fibers include cellulose.

12. A method as in claim 9 wherein said fibers include fibrous molecules formed by condensation polymerization of glucose derivatives.

13. A method as in claim 9 wherein said fibers are selected from a group consisting of chitin and chitosan.

14. A method of manufacturing a loud speaker diaphragm, said method comprising the steps of:

swelling fibers with pressurized water within a pressurized container;

releasing said pressurized swollen fibers to a lower pressure so as to explode the fibers into fibrils from inside the fiber without exerting external mechanical forces; and making a paper loud speaker diaphragm using said fibrils.

15. A method of manufacturing a loud speaker diaphragm, said method comprising the steps of:

forming a water suspension of fibers consisting essentially of polysaccharide molecules;

pressurizing said suspension in a pressure container to around 8 atmospheres of pressure;

permitting said fibers to swell by absorption of pressurized water thereinto;

passing the pressurized swollen fibers out of said pressure container to a lower pressure environment without exerting external impact forces to thereby burst said fibers due to their internal pressurization into fibrils; and using said fibrils to make a paper loud speaker diaphragm.

* * * * *